US006346766B1

(12) United States Patent
Kanao et al.

(10) Patent No.: US 6,346,766 B1
(45) Date of Patent: Feb. 12, 2002

(54) SPARK PLUG FOR INTERNAL COMBUSTION ENGINE AND METHOD FOR MANUFACTURING SAME

(75) Inventors: Keiji Kanao, Chita-gun; Tsunenobu Hori, Kariya, both of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/313,361

(22) Filed: May 18, 1999

(30) Foreign Application Priority Data

May 20, 1998 (JP) ..... 10-138846
Jan. 18, 1999 (JP) ..... 11-009665

(51) Int. Cl.[7] ..... H01T 13/20

(52) U.S. Cl. ..... 313/141; 313/142; 313/144; 445/7

(58) Field of Search ..... 313/141, 142, 313/11.5, 118, 132, 136, 144; 123/169 EL; 445/7

(56) References Cited

U.S. PATENT DOCUMENTS 4,540,910 A * 9/1985 Kondo et al. ..... 313/11.5
4,581,558 A * 4/1986 Takamura et al. ..... 313/141
4,670,684 A * 6/1987 Kagawa et al. ..... 313/141
4,853,582 A * 8/1989 Sato et al. ..... 313/141
5,202,601 A * 4/1993 Takamura et al. ..... 313/142
5,406,166 A * 4/1995 Abe et al. ..... 313/142
RE35,012 E * 8/1995 Takamura et al. ..... 313/141
5,465,022 A * 11/1995 Katoh et al. ..... 313/144
5,488,262 A 1/1996 Takamura ..... 313/141
5,563,469 A * 10/1996 Takamura et al. ..... 313/141
5,990,602 A * 11/1999 Katoh et al. ..... 313/141
6,094,000 A * 7/2000 Osamura et al. ..... 313/141

FOREIGN PATENT DOCUMENTS

GB 2 302 367 1/1997
JP 1-319284 12/1989
JP 9-7733 1/1997

* cited by examiner

*Primary Examiner*—Nimeshkumar D. Patel
*Assistant Examiner*—Karabi Guharay
(74) *Attorney, Agent, or Firm*—Nixon & Vanderhye PC

(57) ABSTRACT

In a spark plug, a chip or a plurality of chips made of Ir alloy are bonded by resistance welding through a stress releasing layer on the respective chip mounting portions of the center and ground electrodes made of Ni base alloy. At the temperature of 900° C., the value of Young's modulus of the stress releasing layer is less than those of the Ir alloy and the Ni base alloy and, further, the value of linear expansion co-efficient of the stress releasing layer is intermediate between those of the Ir alloy and the Ni base alloy. The bonded junction of the chip and the stress releasing layer is shaped as a curved surface.

29 Claims, 9 Drawing Sheets

SPARK PLUG FOR INTERNAL COMBUSTION ENGINE AND METHOD FOR MANUFACTURING SAME

CROSS REFERENCE TO RELATED APPLICATION

This application is based upon and claims the benefit of priority of Japanese Patent Applications No. H.10-138846 filed on May 20, 1998 and No. H.11-9665 filed on Jan. 18, 1999, the contents of which are incorporated herein by reference.

BACKGROUND OF THE INVENTION

1. Field of the Invention

The present invention relates to a spark plug for an internal combustion engine provided with a noble metal chip bonded on a center or ground electrode, in particular, an improvement in bonding strength of the chip made of an iridium (Ir) alloy.

2. Description of Related Art

A spark plug has generally a center electrode fitted through an insulator into a housing and a ground electrode integrated with the housing. The portion of the center electrode exposed out of the end of the insulator faces the ground electrode to form a spark gap within which a spark is discharged. To improve the life time and the performance of the spark plug, a noble metal chip is bonded on the center and/or ground electrode to constitute a spark discharge spot for the spark gap.

Conventionally, a platinum (Pt) alloy has been widely used as the material for the noble metal chip. However, the Pt alloy has, the deficiency that the consumption resistance thereof is not considered to be sufficient to meet the more demanding engine specifications for vehicles in the future. Therefore, the use of the iridium (Ir) alloy having a melting point higher than that of the Pt alloy has been recently studied and an iridium-rhodium (Ir—Rh) alloy and the like have been proposed, as shown in P-A-9-7733.

The material of the center and/or ground electrode on which the chip is bonded is usually a nickel (Ni) base alloy. The difference between the linear expansion co-efficient of the Ni alloy and that of the Ir alloy is larger than the difference between that of the Ni alloy and that of the Pt alloy (for example, 90Pt-101r alloy, 80Pt-201r alloy and the like). Therefore, if a chip made of the Ir alloy is installed on the spark plug to be used in a high temperature combustion chamber, a great thermal stress due to the above mentioned larger difference in linear expansion co-efficients tends to be produced at the junction of the chip and the electrode according to the temperature change.

When a chip made of the Ir alloy is directly bonded on the electrode, laser beam welding is preferable to limit the possible separation of the chip and the electrode during its lifetime because the chip and the electrode may be sufficiently molten due to the high density of its energy. However, as the equipment cost and the fabrication cost of laser be am welding are relatively expensive, electric resistance welding may be desired in view of its inexpensive manufacturing cost, though the welding energy is lower, compared to laser beam welding.

It is well known, as described in JP-A-1-319284, when the chip and the electrode are bonded by resistance welding, to place a stress releasing layer having a linear expansion co-efficient intermediate between that of the chip and that of the electrode between the chip and the electrode in order to alleviate the thermal stress on the chip. The conventional spark plug for this purpose employs an Ir—Ni alloy as the chip and a Pt—Ni alloy as the stress releasing layer.

According to the investigation of the present inventors, it was found effective to bond the Pt alloy on the electrode made of the Ni base alloy, but not always effective to bond the Ir alloy on the electrode in conventional ways. An endurance test result showed that using certain material combinations for the Ir alloy chip and/or the stress releasing layer results in a crack or a separation at the junction of the Ir alloy and the stress releasing layer and, as the worst case, the chip was left out from the stress releasing layer. The greater the weight percent of Ir contained in the Ir alloy for improving the consumption resistance of the chip, the more distinctively this problem has been observed. Further, when the diameter of the Ir alloy (for example, more than 1.5 mm) is relatively large, even if a plurality of the stress releasing layers are employed, because of the larger thermal stress produced, this problem can not be completely solved.

SUMMARY OF THE INVENTION

The present invention has been made in view of the above mentioned problem, and an object of the present invention is to provide a spark plug for internal combustion engines having the most suitable stress releasing layer. In particular, when the Ir alloy chip is bonded through the stress releasing layer on the Ni base alloy center and/or ground electrode by the resistance welding, it is preferable that the value of Young's modulus of the stress releasing layer is less than those of the Ir alloy chip and the Ni base alloy electrode and, further, the value of linear expansion co-efficient of the stress releasing layer is intermediate between those of the Ir alloy chip and the Ni base alloy electrode. The stress releasing layer having the above mentioned value of Young's modulus can effectively absorb or alleviate the thermal stress at the junction of the chip and stress releasing layer, thus, improving the bonding strength of the chip bonded by the resistance welding.

Even if the Ir alloy or the Ir alloy having at least one of material such as rhodium (Rh), platinum (Pt), ruthenium (Ru), palladium (Pd) and tungsten (W) contains more than 50 weight percent (Wt %) of Ir, the above mentioned stress releasing layer will serve to prevent the separation or the crack at the junction.

More particularly, it is preferable to use a stress releasing layer, whose Young's modulus falls within $5\times10^4$ Mpa and $15\times10^4$ Mpa at a temperature of 900° C., under which the spark plug is generally exposed in the engine combustion chamber at a full load operation of the engine ( for example, at an engine revolution of 6000 rpm). The lower limit of Young's modulus, $5\times10^4$ Mpa, was determined from the standpoint that, when the Young's modulus of the stress releasing layer is less than the above lower limit, there is a fear of producing a crack, not at the junction portion, but on the stress releasing layer itself because the material is too soft as its nature. Further, it is preferable that the linear expansion co-efficient of the stress releasing layer falls within $10\times10^{-6}$ (/° C.) and $11\times10^{-6}$ (/° C.).

To achieve the above object, an alloy containing Pt or a Pt—Ir—Ni alloy, more specifically, an alloy containing 65 to 89 Wt % of Pt, 10 to 30 Wt % of Ir and 1 to 5 Wt % of Ni, can be used as material of the stress releasing layer.

As to the thickness of the stress releasing layer, more than 0.2 mm is found to be preferable to obtain a reliable bonding strength according to the experimental test result of the present inventors. If the thickness of the stress releasing layer is less than 0.2 mm, a crack tends to be produced on the stress releasing layer itself. On the other hand, if the thickness of the stress releasing layer exceeds 0.6 mm, the bonding strength is saturated. Therefore, the upper limit of the thickness of the stress releasing layer is preferably 0.6 mm in view of material cost savings.

Furthermore, it will be effective, in particular in the case of a relatively large diameter of the chip, to employ two stress releasing layers for alleviating the thermal stress step by step. In addition to a first stress releasing layer as mentioned above, there is provided, between the first stress releasing layer and the electrode, a second stress releasing layer having a linear expansion co-efficient intermediate between those of the first stress releasing layer and the electrode. For this purpose, a Pt—Ir alloy may be used as the first stress releasing layer and a Pt—Ni alloy as the second stress releasing layer.

It is another object to provide a spark plug for internal combustion engine having an Ir alloy chip to be bonded through a stress releasing layer on a Ni base alloy electrode, in which the junction of the chip and the stress releasing layer is constituted by a curved surface. As described in FIG. 13, the conventional junction has a plain surface portion J3 and an edge portion J4 formed by a part of the disk or column type chip J1 buried into the stress releasing layer J2 when the chip J1 is bonded by the resistance welding on the stress releasing layer J4 whose diameter is larger than that of the chip J1. The bonding strength of the edge portion J4 is inherently weak as the nature of the resistance welding and, further, the thermal stress is focussed on the edge portion J4 as it is affected in the directions shown in arrows in FIG. 13. Therefor, it may be considered that the separation of the chip J1 from the stress releasing layer J2 tends to occur from the edge portion J4.

On the other hand, the thermal stress is dispersed uniformly on whole area of the junction in case of the curved junction surface without the edge portion. The experimental result of the present inventors has clearly proved that there was a big difference between the plain surface with the edge portion and the uniformly curved surface with respect to the separation percentage of the chip and the stress releasing layer.

The further object of the present invention is to provide a spark plug having a plurality of chips to be bonded on a single stress releasing layer. As the size of the chip is larger, the thermal stress is more heavily affected on the chip. Therefor, if the chip can be constituted by a plurality of smaller chips and the respective smaller chips are bonded on a single stress releasing layer, the thermal stress impact on each of the chips may be alleviated and the bonding strength of the chip as a whole can be improved.

It is desired, further, that the diameter of each disk type chip be less than 1.5 mm before bonding on the stress releasing layer. Furthermore, it will be more effective for improving the bonding strength to have a combination where the chip is constituted by a plurality of small chips and the junction of each chip and the stress releasing layer is shaped as a curved surface. In this case, the preferable range of the diameter of the chip is between 2.0 mm and 0.1 mm.

Finally, as a method of forming the curved surface junction of the chip and the stress releasing surface, it is preferable that a ball type chip made of an Ir alloy containing more than 50 Wt % of Ir is bonded through the stress releasing layer on the electrode by resistance welding.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
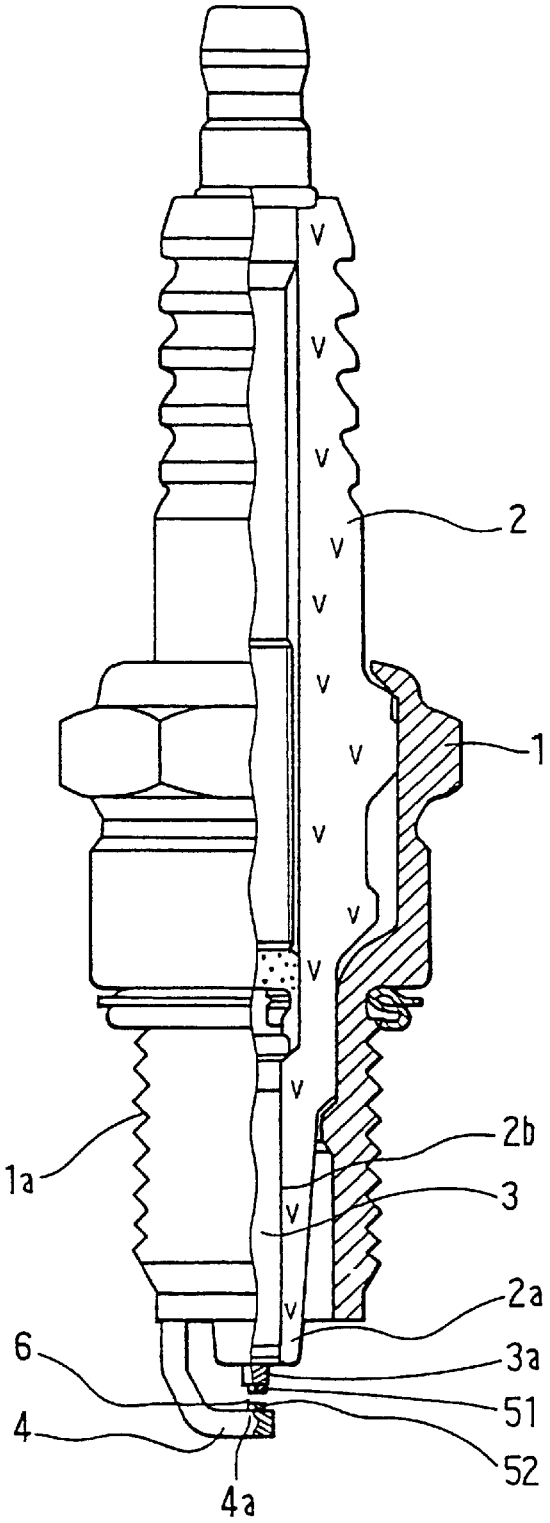
FIG. 1 is a semi cross sectional view of a spark plug according to the present invention.

FIG. 1 shows a semi-cross-sectional view of a spark plug for an internal combustion engine according to the present invention. The spark plug has a tubular housing 1 having a thread 1*a* for mounting to an engine cylinder block (not shown). An insulator 2 made of alumina ceramics ($Al_2O_3$) is fitted into the housing 1 and an end portion 2*a* of the insulator 2 is exposed out of the end of the housing 1. A center electrode 3 is inserted and fixed at a through hole 2*b* of the insulator 2 so as to be held by and insulated with the housing 1 through the insulator 2. A leading end portion 3*a* of the center electrode 3 is exposed out of the end portion 2*a* of the insulator 2. The center electrode 3 is a column whose inner member is composed of metal material having good thermal conductivity such as copper and whose outer member is composed of metal material having good heat resistance and corrosion endurance such as Ni base alloy.

A ground electrode 4 is fixed by welding at the end of the housing 1 and extends to be shaped nearly L. A leading end portion 4*a* opposite to the welding portion of the ground electrode 4 faces the leading end portion 3*a* of the center electrode 3 with a gap 6 for spark discharge. The inner member of the ground electrode 4 is composed of metal material having good thermal conductivity such as copper and the outer member thereof is composed of metal material having good heat resistance and corrosion endurance such as Ni base alloy, which are similar to the center electrode 3.

Figure 2:
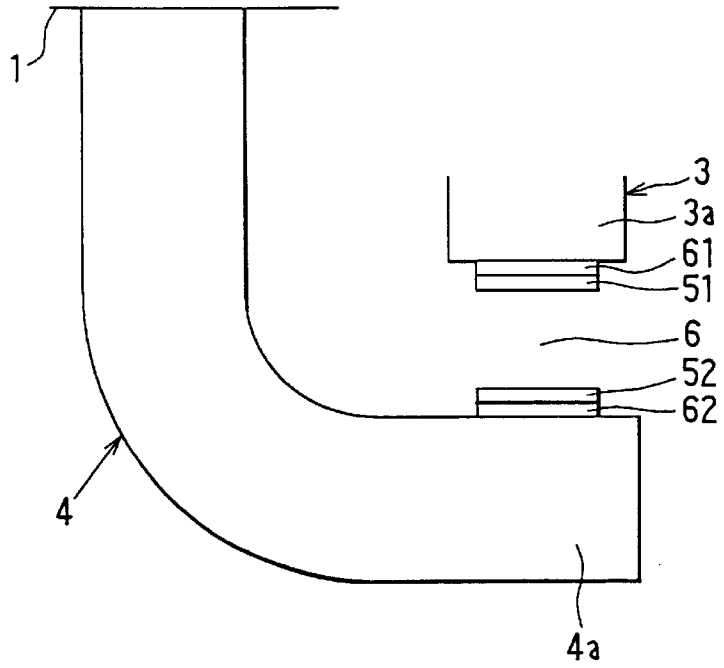
FIG. 2 is a partly enlarged view of FIG. 1 showing a portion where center and ground electrodes face each other according to a first embodiment of the present invention.
Figure 3:
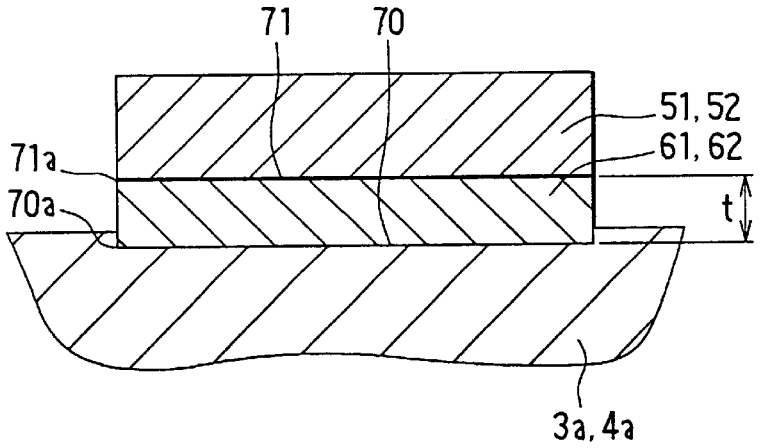
FIG. 3 is a cross sectional view of the junction portion of a chip and a stress releasing layer.

FIG. 2 is a partly enlarged view of FIG. 1 showing a portion where the center and ground electrodes face each other according to a first embodiment of the present invention. As shown in FIG. 2, a chip 51 (discharge spot) made of Ir alloy (90 Wt % Ir-10 Wt % Rh in this embodiment) is bonded by resistance welding on the leading end portion 3*a* of the center electrode 3 through a stress releasing layer 61. On the other hand, a chip 52 (discharge spot) made of Ir alloy (90 Wt % Ir-10 Wt % Rh in this embodiment) is bonded by resistance welding on the leading end portion 4*a* of the ground electrode 4 through a stress releasing layer 62. The cross sectional view of the junction portion of the chip 51 or 52 is described in FIG. 3. The view of the junction portion of the chip 51 and that of the chip 52 are quit same.

Each of the chips 51 and 52 is shaped a disk, whose diameter is 1.0 mm and whose thickness is 0.3 mm. A gap between the chips 51 and 52 (for example, 1 mm) constitutes the spark discharge gap 6 mentioned above. Each of the stress releasing layers 61 and 62 is a disk type layer, whose diameter is the same to that of the respective chips 51 and 52 and whose thickness is 0.2 to 0.6 mm. Material of the leading end portion (chip mounting portion) 3*a* of the center electrode 3 and that of the leading end portion (chip mounting portion) 4*a* of the ground electrode 4 are a Ni base alloy and Inconel (trade mark) are used for this embodiment.

According to the present invention, the value $\alpha$ of linear expansion co-efficient of each of the stress releasing layers 61 and 62 is intermediate between those of the respective Ir alloy chips 51 and 52 and the respective Ni alloy leading end portions 3*a* and 4*a* and, further, the value E of Young's modulus of each of the stress releasing layers 61 and 62 is less than those of the above Ir alloy and the above Ni alloy. The above result is based on extensive studies and experimental tests with respect to various material of the stress releasing layer 61 or 62. Some of the examples of those studies will be described hereinafter. How the chip 51 or 52, the stress releasing layer 61 or 62 and the leading end portion 3*a* or 4*a* are constructed and welded are same on the both sides of the center electrode 3 and the ground electrode 4. Therefor, the below discussion is just focussed on the side of the ground electrode 4.

According to the present experiment, the chip 52 is a disk made of Ir-10 Rh alloy (containing 90 Wt % of Ir and 10 Wt % of Rh ), whose diameter is 1.0 mm and whose thickness is 0.3 mm. The material of the ground electrode 4 is Inconel (trade mark) based on Ni base alloy as mentioned above. As material of the stress releasing layer 62, Pt-20 Ir alloy (which means containing 80 Wt % of Pt and 20 Wt % of Ir and, with respect to the below alloys, the expression is similar), Pt-20Ir-2Ni alloy, Pt-10Ni alloy and Ir-50Ni alloy are prepared. The value a of the linear expansion co-efficient of each of the above alloys is intermediate between those of the Ir-10Rh alloy, material of the chip 52, and Inconel.

Each of the above alloys is a disk, whose diameter is 1.0 mm and whose thickness is 0.2. Speaking to the value $\alpha$ ($\times 10^{-6}$/° C.) of the linear expansion co-efficient of each of the alloys, in case of the chip 52, $\alpha$ of the Ir-10Rh alloy=7.8, in case of the stress releasing layer 62, a of the Pt-20 Ir alloy=9.5, $\alpha$ of the Pt-20Ir-2Ni alloy=10.5, $\alpha$ of the Pt-10Ni alloy=11.6 and $\alpha$ of the Ir-50Ni alloy=11.3 and, in case of the electrode 4, $\alpha$ of the Ni base alloy=14.8. A resistance welding was carried out, at first, on bonding the stress releasing layer 62 on the leading end portion 4*a* of the ground electrode 4 and, then, on bonding the chip 52 thereon. As welding conditions, the pressing force is 30 kg, the current is 1200 A and the number of cycles is 10.

Figure 4:
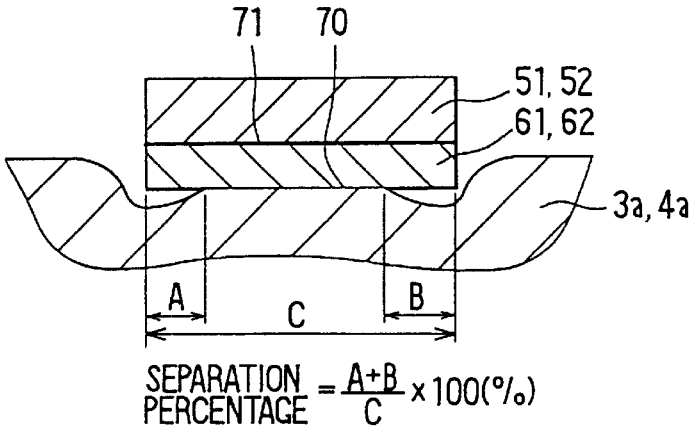
FIG. 4 is an explanatory drawing of a separation percentage.

Using the samples of the spark plugs incorporating the chip 52 bonded by resistance welding through each of the various stress releasing layers 62 on the leading end portion 4*a* of the ground electrode 4, an endurance test has been conducted with respect to the bonding strength of each of the above mentioned stress releasing layers 62. The test was carried in a 6-cylinder, 2000 cc engine operated during 100 hours with repetition of a cycle that an idling operation (about 300° C.) is kept for one minuet and a full throttle operation (about 900° C.) of 6000 rpm for one minute. The bonding strength was evaluated, as described in FIG. 4, by the separation percentage (%), that is, the ratio (A+B)/C of the separation length (A+B) to the diameter of chip or stress releasing layer (C) which is multiplied by 100. The above endurance test results are described in FIGS. 5A and 5B, in which the relationship between the value $\alpha$ of linear expansion co-efficient and the separation percentage (%) is shown.

Figure 5A:
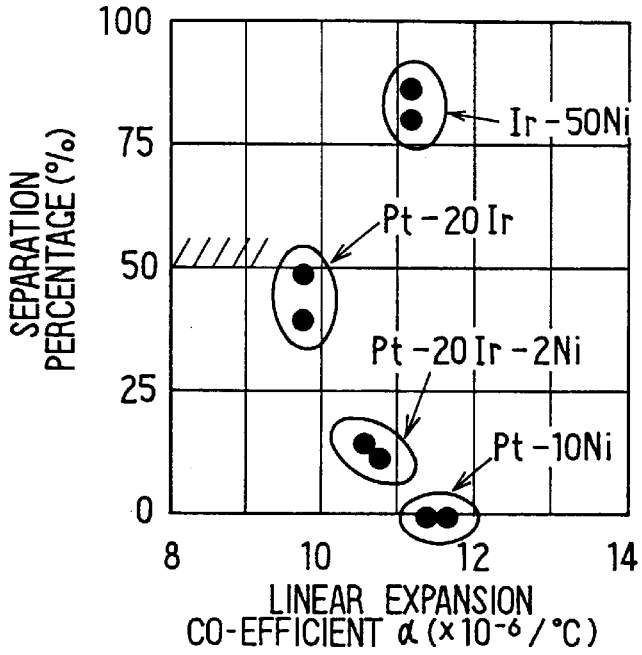
FIG. 5A is a graph showing the relationship between the linear expansion co-efficient and the separation percentage with respect the junction of the electrode and the stress releasing layer.
Figure 5B:
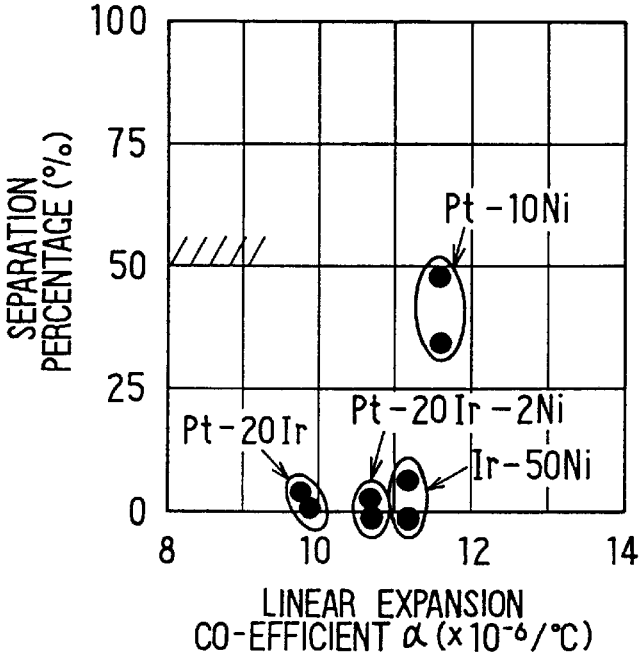
FIG. 5B is a graph showing the relationship between the linear expansion co-efficient and the separation percentage with respect the junction of the chip and the stress releasing layer.

FIG. 5A is concerned with the junction 70 of the leading end portion 4*a* of the electrode and the stress releasing layer 62 and FIG. 5B with the junction 71 of the chip 52 and the stress releasing layer 62. It is necessary to satisfy the bonding strength of both of the junctions 70 and 71 constituted by bonding the chip 52 on the stress releasing layer 52. If the separation percentage after the endurance test is less than 50%, the bonding strength is presumed to have been satisfied. In case of the stress releasing layer of Pt alloy (Pt-20Ir, Pt-20Ir-2Ni and Pt-10Ni), the separation percentage of each of the junctions 70 and 71 is less than 50% and the bonding strength thereof is satisfied, as shown in FIGS. 5A and 5B. However, in case of the Ir alloy (Ir-50Ni), the separation percentage of the junction of the stress releasing layer and the leading end portion is more than 50% and the bonding strength can not be satisfied. Therefor, the Ir alloy is not appropriate as the stress releasing layer of the present invention.

Speaking to the value E ($\times 10^4$ MPa) of Young's modulus of each of the alloys, in case of the chip 52, E of the Ir-10Rh alloy=38.0, in case of the stress releasing layer 62, E of the Pt-20 Ir alloy=10.6, E of the Pt-20Ir-2Ni alloy=10.8, E of the Pt-10Ni alloy=11.0 and E of the Ir-50Ni alloy=25.0 and, in case of the electrode 4, E of the Ni base alloy=15.6. The respective values E of the Pt alloys are almost constant and less than those of the Ir-10Rh alloy for the chip 52 and the Ni base alloy for the leading end portion 4*a*. However, the value E of the Ir-50Ni is intermediate between those of the Ir-10Rh alloy and the Ni base alloy.

Figure 6:
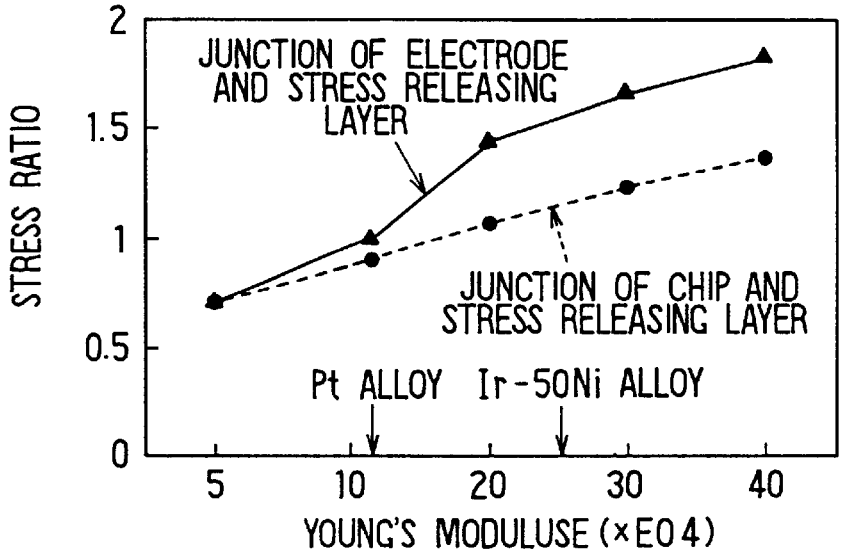
FIG. 6 is a graph showing the relationship between Young's modulus and thermal stress based on FEM analysis.

FIG. 6 describes the relationship between Young's modulus mentioned above and the thermal stress based on FEM analysis of the present inventors, which shows that the thermal stress becomes bigger as the value E of Young's modulus of the stress releasing layer is larger. The value $\alpha$ of the linear expansion co-efficient of the stress releasing layer is 11.0 ($\times 10^{-6}$/° C.) which is about middle between those of the Ir-10Rh and Inconel. As the value of the thermal stress, the maximum value of the stress produced at each of the edge portions 70*a* and 71*a* of the junctions 70 and 71 is used and, under the presumption that the thermal stress value at the junction 70 of the Pt alloy stress releasing layer and the Ni base alloy electrode is a reference value 1, the ratio of each of the thermal stress values to the reference value is shown in FIG. 6.

According to the results described in FIGS. 5A, 5B and 6, it was concluded to be preferable that the value E of Young's modulus of the stress releasing layer at the temperature of 900° C. is less than that of Inconel, that is, less than those of both of the chip and the electrode, as the value E of Young's modulus of the Ir alloy chip is larger than that of the Ni base alloy electrode. Further, if the value E of Young's modulus is too small, there is a fear of the crack on the stress releasing layer itself because the material is too soft. Therefor, it was concluded that the value E of Young's modulus at the temperature of 900° C. ($\times 10^4$ Mpa) should be between 5 to 15.

In case that material of the electrode is Ni base alloy and material of the chip is Ir alloy, it was found to be necessary as the stress releasing layer for satisfying the bonding strength that the value $\alpha$ of the linear expansion co-efficient of the stress releasing layer is intermediate between those of the Ir alloy and the Ni base alloy and the value E of Young's modulus thereof is less than those of the Ir alloy and the Ni base alloy.

With respect to the stress releasing layer 62 made of Pt-20Ir-2Ni, the separation percentages at the junctions 70 and 71 are below 25% and the bonding strength is the largest among the alloys above tested, as shown in FIG. 5. As the result of the studies of the present inventors, it was found that Pt—Ir—Ni alloy having 65 to 85 Wt % of Pt, 10 to 30 Wt % of Ir and 1 to 5 Wt % of Ni has the same bonding strength effect as the Pt-20Ir—Ni and the value a of the linear expansion co-efficient thereof at the temperature of 900° C. is preferably 10 to 11 ($\times 10^{-6}$/° C.).

Figure 7:
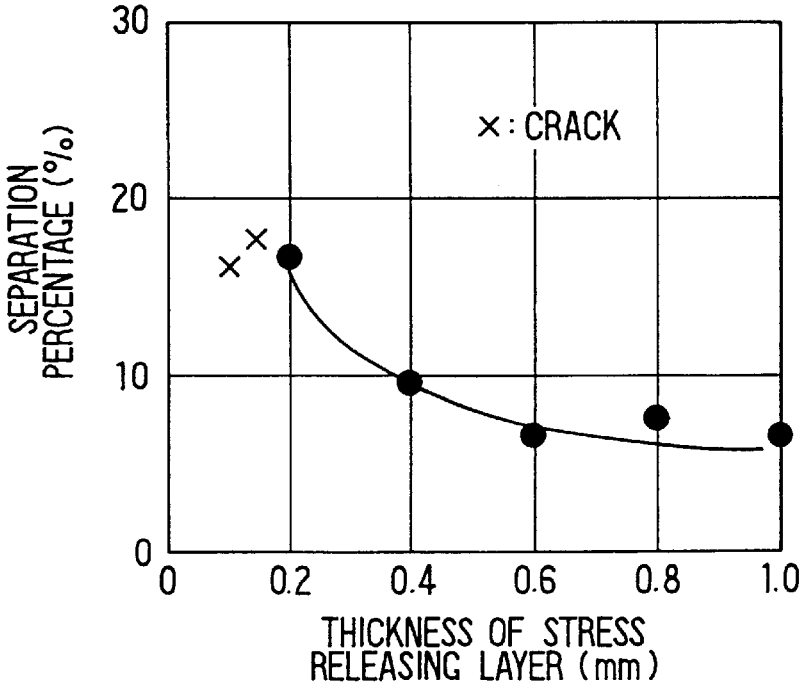
FIG. 7 is a graph showing the relationship between the thickness of the chip and the separation percentage with respect to the junction of the electrode and the stress releasing layer.

According to the above mentioned tests, the thickness t (refer to FIG. 3) of the stress releasing layer 62 was defined as 0.2 to 0.6 mm. This is based on the result of the studies regarding the relationship between the diameter of the stress releasing layer or the chip and the bonding strength at the junction 70 or 71. FIG. 7 shows the endurance test result of the separation percentage at the junction 70 of the respective stress releasing layers made of Pt-20Ir-2Ni alloy, each thickness of which t is different and varied from 0.1 to 1.0 mm. As clearly understood from FIG. 7, the thicker the thickness of the stress releasing layer is, the smaller is the separation percentage and, when exceed 0.6 mm, the separation percentage is nearly constant. With respect to the thickness t=0.1 and the thickness t=0.15 (marked x in FIG. 7), the lateral crack was observed on the stress releasing layer 62 itself, though the separation percentage at the junction 70 is allowable. Further, the test result of the other materials of the stress releasing layer 62 showed the same tendency as the Pt-20Ir-2Ni alloy. Therefor, it is concluded that the thickness of the stress releasing layer is within the range of 0.2 to 0.6 mm as a practical use.

Though the above explanation is focussed on the stress releasing layer 62 on the side of the ground electrode 4, the value $\alpha$ of the linear expansion co-efficient, the value E of Young's module and the thickness t of the stress releasing layer 61 on the side of the center electrode 3 may be also similarly defined as the stress releasing layer 62 on the side of the ground electrode 4.

The spark plug incorporating the embodiment of the present invention mentioned above has a characteristic of, not only alleviating the thermal stress at least to the same extend as the conventional spark plug because the value a of the linear expansion co-efficient of each of the stress releasing layers 61 and 62 is intermediate between those of the Ir alloy and the Ni base alloy, but also further alleviating the thermal stress because of the employment of the softer material of the stress releasing layers 61 and 62, whose respective values E of Young's modulus fall within those of the Ir alloy and the Ni base alloy. Therefor, the bonding strength of the chips 51 and 52 can be increased.

According to the above embodiment, the resistance welding is carried out twice in such a way that, at first, the stress releasing layer 61 or 62 is bonded on the leading end portion 3*a* or 4*a* and, then, the chip 51 or 52 is bonded thereon by the resistance welding. However, a clad material made in a manner that the chip 51 or 52 and the stress releasing layer 61 or 62 are preliminarily connected makes it possible to bond them by the resistance welding at one time.

Figure 8:
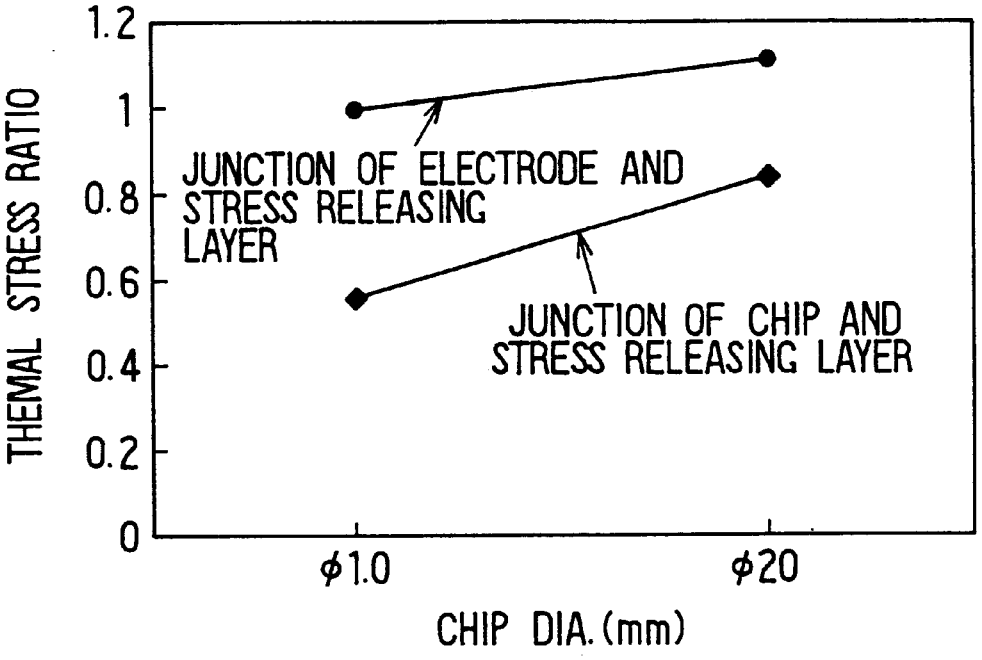
FIG. 8 is a graph showing the relationship between the chip diameter and the thermal stress ratio based on FEM analysis.

Further, the larger the respective junction areas of the chip, the stress releasing layer and the leading end portion of the electrodes are, the more heavily the thermal stresses is affected thereon. FIG. 8 shows the relationship between the chip diameter and the thermal stress ratio based on the FEM analysis. In FIG. 8, when the diameter of the chip 52 (the stress releasing layer 62) is 1.0 mm or 2.0 mm and the total of each thickness of the chip (0.3 mm) and each thickness of the stress releasing layer (0.2 mm) is 0.5 mm, the respective thermal stress values at the junctions 70 and 71 are shown as the ratio as similarly described in FIG. 6. As understood from FIG. 8, the larger the diameter of the chip is, the bigger is the thermal stress ratio, that is, the more easily the junction tends to be separated.

Figure 9:
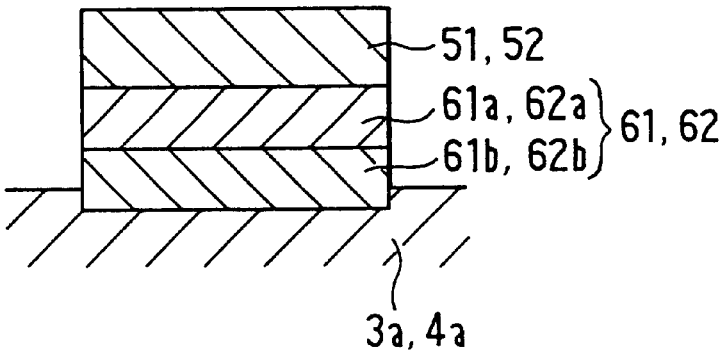
FIG. 9 is a cross sectional view of the junction of the chip and the stress releasing layers according to the modified embodiment.

To cope with the problem of the larger diameter of the chip, it is preferable to have two stress releasing layers as described in FIG. 9. In addition to a first stress releasing layer 62*a* provided on the side of the chip 52, there is provided, between the first stress releasing layer 62*a* and the leading end portion 4*a* of the electrode 4, with a second stress releasing layer 62*b* having the value of the linear expansion co-efficient intermediate between those of the first stress releasing layer 62*a* and the Ni base alloy. The center electrode 3 may be also provided with two layers of first and second stress releasing layers. In this case, as the respective values of the linear expansion co-efficient of the first and second stress releasing layers 62*a* and 62*b* may be changed step by step between those of the chips 51 and 52 and the Ni base alloy, the thermal stress may be alleviated step by step. The construction of FIG. 9 is effective when the diameter of the chip or the stress releasing layer is relatively large (for example, more than 1.5 mm). For this purpose, a Pt—Ir alloy may be used as the first stress releasing layer and a Pt—Ni alloy as the second stress releasing layer.

In the embodiment mentioned above, the chips 51 and 52 and the stress releasing layers 61 and 62 may be shaped in a column or a square pillar in addition to the disk explained above. Further, the above invention is applicable irrespective of whether or not the diameter of the chip 51 or 52 is larger or smaller than that of the stress releasing layer 61 or 62.

Figure 10:
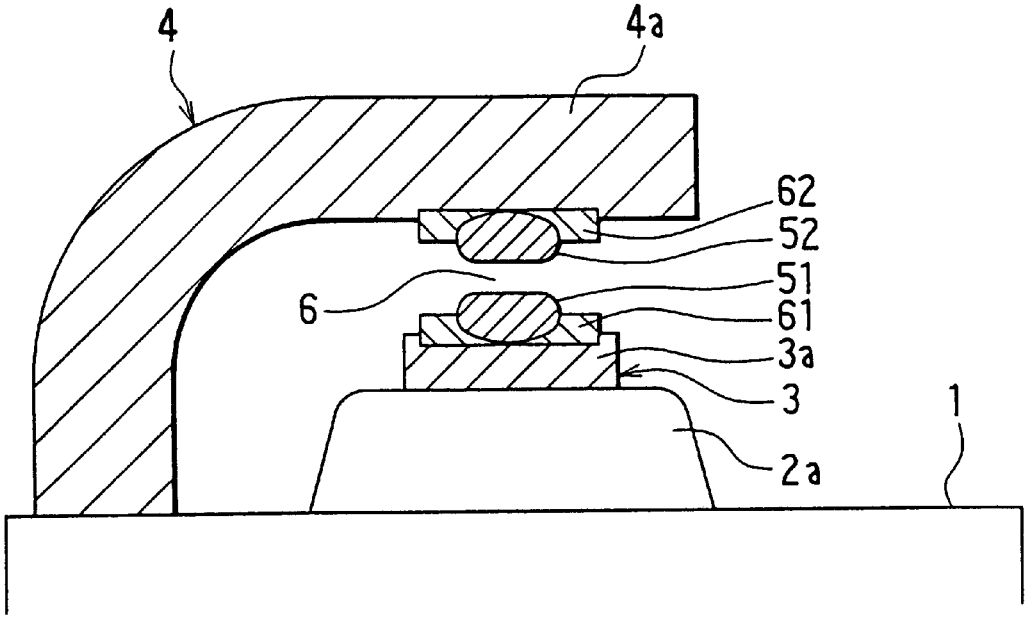
FIG. 10 is a cross sectional view showing a portion where the center and ground electrodes of the spark plug face each other according to the second embodiment of the present invention.

A second embodiment of the spark plug applicable in particular for internal combustion engines in use of co-generation devices, gas pressure transfer pumps, vehicles and so on will be described hereinafter. FIG. 10 is a cross sectional view showing a portion where the center and ground electrodes of the spark plug face each other. As shown in FIG. 10, a chip 51 (discharge spot) made of Ir alloy (containing more than 50 Wt % Ir in this embodiment) is bonded by resistance welding on the leading end portion 3*a* of the center electrode 3 through a stress releasing layer 61.

On the other hand, a chip 52 (discharge spot) made of Ir alloy (containing more than 50 Wt % Ir in this embodiment) is bonded by resistance welding on the leading end portion 4*a* of the ground electrode 4 through a stress releasing layer 62. A gap between the chips 51 and 52 (for example, 1 mm) constitutes the spark discharge gap 6. The cross sectional view of the junction portion of the respective chips 51 and 52 is described in FIG. 11. The views of the junction portion of the chip 51 and that of the chip 52 are quit same.

The material of the leading portion 3*a* of the center electrode 3 and that of the leading portion 4*a* of the ground electrode 4 are Ni base alloy and Inconel (trade mark) is used for this embodiment. The value of linear expansion co-efficient of each of the stress releasing layers 61 and 62 is intermediate between those of the respective Ir alloy chips 51 and 52 and the respective Ni alloy leading end portions 3*a* and 4*a* and, further, the value E of Young's modulus of each of the stress releasing layers 61 and 62 is less than those of the above Ir alloy and the above Ni alloy.

Figure 11:
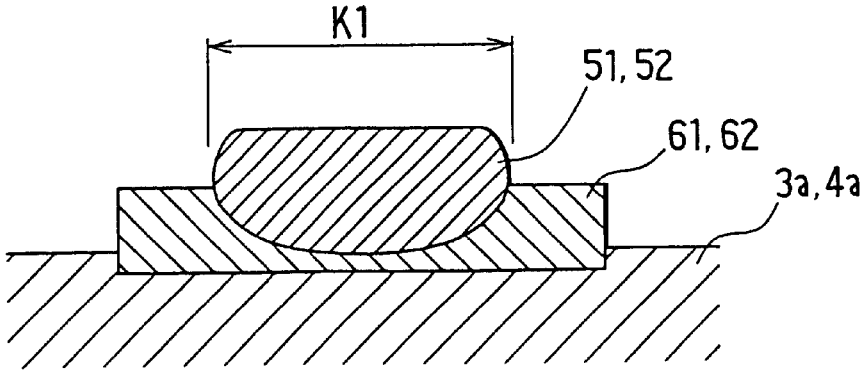
FIG. 11 is a cross sectional view of the junction portion of a chip and a stress releasing layer.
Figure 12:
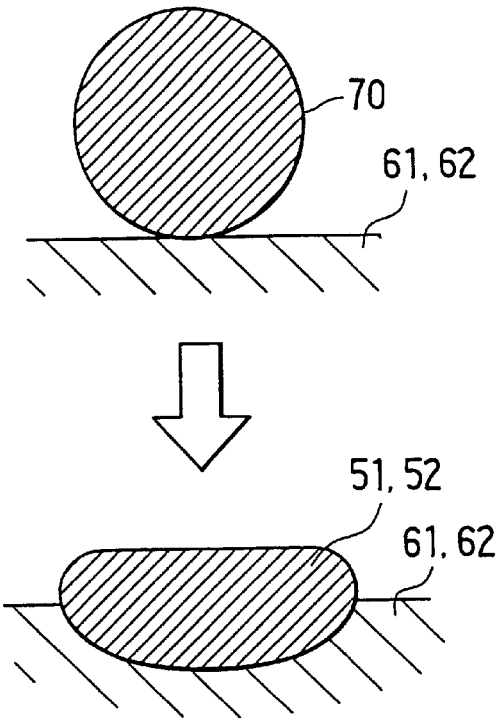
FIG. 12 is an explanatory drawing showing a method for manufacturing the spark plug according to the second embodiment.

Each of the stress releasing layers 61 and 62 is a disk type layer, whose thickness is 0.2 to 0.6 mm. Each of the chips 51 and 52 is shaped, before the resistance welding, as a ball 70, whose diameter is 0.1 to 2.0 mm. The respective chips 51 and 52 are partly buried into the stress releasing layers 61 and 62 and each of the junctions of the chips 51 and 52 and the stress releasing layers 61 and 62 is constituted by a curved surface. As shown in FIGS. 11 and 12, the bonded junction of the chip 51, 52 and the stress releasing layer 61, 62 is shaped as a uniformly curved dome surface extending to an exposed surface of the stress releasing layer.

As material of the chips 51 and 52, the Ir alloy containing more than 50 Wt % of Ir with at least one of materials such as rhodium (Rh), platinum (Pt), ruthenium (Ru), palladium (Pd) and tungsten (W) can be employed and Ir-10 Rh alloy is used in this embodiment. As material of the stress releasing layers 61 and 62, a Pt-20 Ir alloy (which means containing 80 Wt % of Pt and 20 Wt % of Ir and, with respect to the below alloys, the expression is similar), a Pt-20Ir-2Ni alloy, a Pt-10Ni alloy and the like are employed.

The respective bonding junctions of the leading end portions 3*a* and 3*b*, the chips 51 and 52 and the stress releasing layers 61 and 62 may be constituted in a manner that a ball shaped chip 70, as shown in FIG. 12, is respectively bonded through the stress releasing layers 61 and 62 on the leading end portions 3*a* and 3*b* by the resistance welding. As welding conditions, for example, the pressing force is 30 kg, the current is 1200 A and the number of cycles is 10. A plain portion is constituted on the chip at the upper surface thereof after the welding, as shown in FIG. 12, as the pressure force is applied on the ball 70 from the above side of the drawing.

Figure 13:
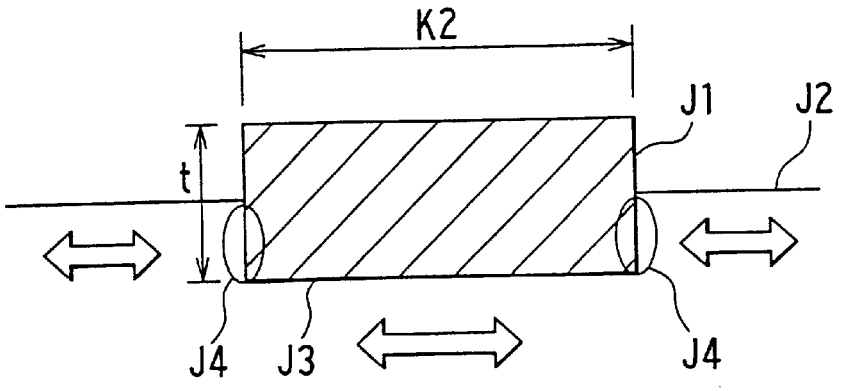
FIG. 13 is an enlarged cross sectional view of the chip bonding portion of the conventional spark plug.

With respect to the curved junction of the chip and the stress releasing layer, it is considered that the thermal stress may be dispersed uniformly on whole area of the function. To prove the difference between the plain surface shown in FIG. 13 and the curved surface of the present invention with respect to the separation percentage of the junction of the chip and the stress releasing layer, an experimental test was conducted by using the chip J1 shown in FIG. 13 and the chip 51 or 52 shown in FIG. 11. Each of the chip J1 (the thickness=0.3 mm) and the chip 51 or 52 is made of the Ir-10Rh alloy and each of the stress releasing layers J2 and 61 or 62 is made of the Pt-20Ir-2Ni alloy. The endurance test was carried in a 6-cylinder, 2000 cc engine operated during 100 hours with repetition of a cycle that an idling operation (about 300° C.) is kept for one minute and a full throttle operation (about 900° C.) of 6000 rpm for one minute.

Figure 14A:
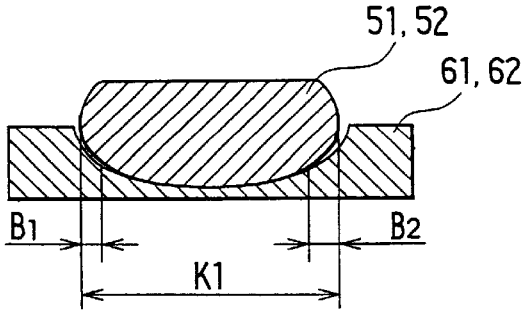
FIG. 14A is a drawing showing the definition of separation percentage with respect to the curved junction of the chip and stress releasing layer.
Figure 14B:
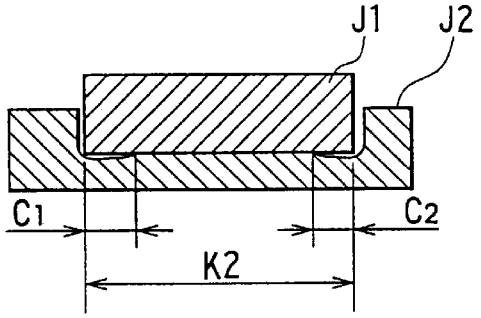
FIG. 14B is a drawing showing the definition of separation percentage with respect to the plain junction of the chip and stress releasing layer.

After the test, the respective separation percentages as shown in FIGS. 14A and 14B were investigated. The separation percentage is the ratio $(B_1+B_2/K1)$ or $(C_1+C_2/K2)$ of the separation length $(B_1+B_2)$ or $(C_1+C_2)$ to the chip diameter (K1 or K2) after welding which is multiplied by 100. The relationship between the separation percentage (%) and the chip diameter before welding (mm) is illustrated in FIG. 15 in which the disk chip J1 is shown as the disk chip and the chip of the present embodiment 51 or 52 as a ball chip.

Figure 15:
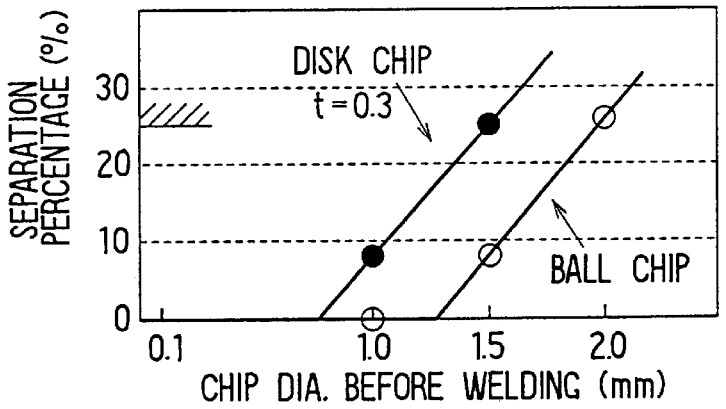
FIG. 15 is a graph showing the relationship between the chip diameter before welding and the separation percentage.

As shown in FIG. 15, there is a clear difference of the separation percentage between the plain surface junction and the curved surface junction. If the separation percentage is less than 25%, the bonding strength of the junction is satisfactory for the practical use. In case of the chip 51 or 52 having the curved surface junction, the value of the separation percentage is remarkably lower than that of the chip J1 having the plain surface junction. In another word, the curved surface junction of the chip and the stress releasing layer serves to limit the separation of the chip from the stress releasing layer so as to increase the bonding strength. Further, the separation of the junction can be sufficiently limited, if the diameter of the chip before welding is less than 2.0 mm (preferably, less than 1.5 mm) in case of the curved surface junction.

According to the present invention, the ball 70 of the chip 51 or 52 is partly deformed to constitute a plain surface, as shown in FIG. 11, by the pressing force of the resistance welding and, therefor, the discharge spot area is enlarged. On the other hand, in case of the disk chip J1, the enlargement of the discharge spot area due to the deformation by the pressing force can not be so large, compared with the enlargement in case of the ball chip. How largely the discharge spot area is formed may be understood from FIG. 16.

Figure 16:
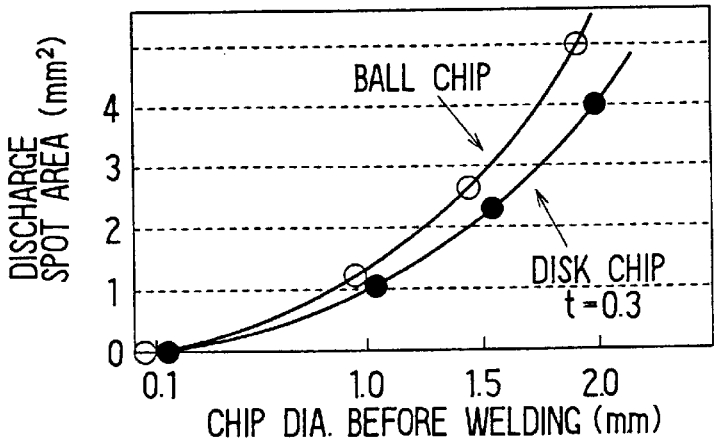
FIG. 16 is a graph showing the relationship between the chip diameter before welding and the discharge spot area.

FIG. 16 shows the relationship between each diameter (mm).of the disk chip J1 and the ball chip 51 or 52 before welding and the area ($mm^2$) of the discharge spot of the respective chips (the area facing the discharge gap), while material of the chip J1, 51 or 52 is same as mentioned above for the endurance test. As shown in FIG. 16, in case that the diameter of the ball 70 is less than 0.1 mm, the discharge spot area is almost near 0 and this construction is not adequate. It is preferable to secure the consumption resistance that the diameter of the ball 70 is more than 0.1 mm.

As mentioned above, it can be easily said that the larger the size or the volume of the chip is, the more heavily the thermal stress is affected on the junction surface. This will be understood from FIG. 15 showing that the more larger separation of the junction of the chip and the stress releasing layer tends to occur according to the enlargement of the chip diameter or volume.

A third embodiment of the present invention will be described with reference to FIGS. 17A, 17B, 18A and 18B.

Figure 17A:
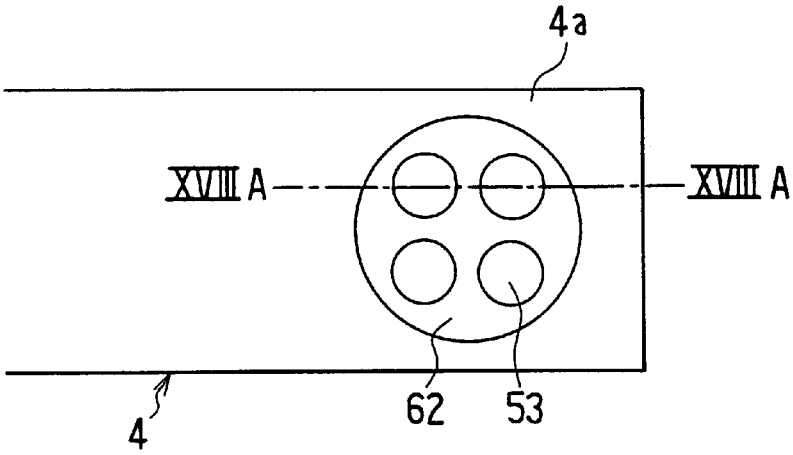
FIG. 17A is a view of the ground electrode on which plural of chips are bonded through a stress releasing layer according to a third embodiment.
Figure 17B:
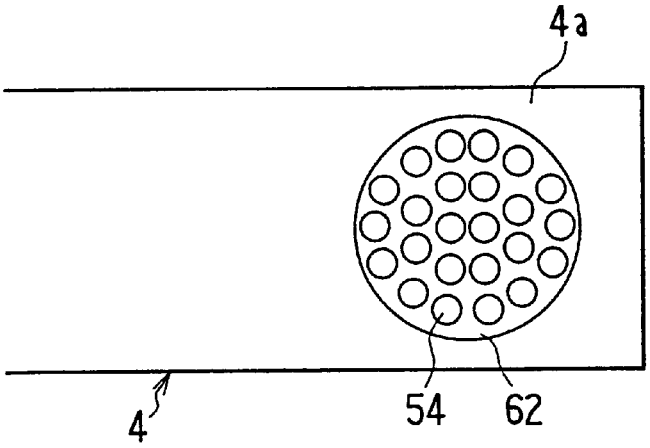
FIG. 17B is a view of the ground electrode on which plural chips are bonded through a stress releasing layer according to a modified third embodiment.
Figure 18A:
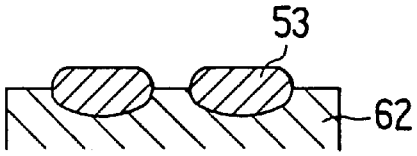
FIG. 18A is a cross sectional view taken along a line XVIIIA—XVIIIA of FIG. 17A.
Figure 18B:
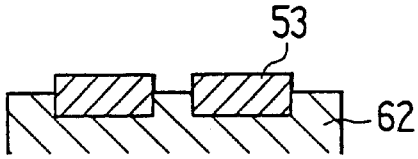
FIG. 18B is a modification of FIG. 18A.

FIG. 17A or 17B shows a construction on a side of the ground electrode 4 viewed from the side of the center electrode 3, in which a plurality of chips 53 or 54 are bonded on a stress releasing layer 62 in view of limiting the thermal stress by using smaller sized chips. FIG. 18A or 18B is a cross sectional view taken along a line XVIIIA—XVIIIA of FIG. 17A. The construction of the chips and the stress releasing layer on the side of the center electrode 3 may be the same as mentioned above. Material of the chip 53 or 54 may be the same as that explained in the previous embodiments. According to this embodiment, the thermal stress impact can be alleviated and the separation of the chip and the stress releasing layer can be limited to improve the bonding strength, as a plurality of relatively small sized chips are employed. Further, the stress releasing layer may be a single layer because of the lower thermal stress and the material cost can be saved so far.

Each junction of the plurality of chips and the stress releasing layer may be shaped as a curved surface as shown in FIG. 18A or as a plain surface as shown in FIG. 18B. In the case of the former, as shown in FIG. 18A, each of the chips is partly embedded into the stress releasing layer and the bonded junction between the chip and the stress releasing layer is shaped as a uniformly curved dome surface extending to an exposed surface of the stress releasing layer. The construction of the chips 54 and the stress releasing layer 61 or the construction of the chips 53 or 54 and the stress releasing layer 61 on the side of the center electrode 3 is same as the construction of the chips 53 and the stress releasing layer 62 as shown in FIG. 18A or FIG. 18B. In case of the curved surface junction, a plurality of balls are used as chip material and, in case of the plain surface junction, a plurality of disks are used as chip material. These balls or disks are bonded in the same way of resistance welding as mentioned in the first or second embodiment of the present invention. Further, in case of the curved surface junction, the structure of each of the chips 53 or 54 may be the same as that of the chip 51 or 52 as explained in the second embodiment and the function and effect as mentioned in the second embodiment can be expected in addition to the merit of the plurality of chips so as to further increase the bonding strength.

In case of the plain surface junction, each diameter of the disk chips 53 or 54 is preferably less than 1.5 mm before welding. If the diameter of the chip is less than 1.5 mm, the separation percentage is kept less than 25% as shown in FIG. 15, which may be practically used. As understood from FIG. 15, it is more preferable that the diameter of the chip before welding is less than 1.0 mm, but, more than 0.1 mm to secure the discharge spot area as shown in FIG. 16. It goes without saying that the respective chips on the side of the ground electrode 4 and the respective chips on the side of the center electrode 3 face each other to constitute respectively a discharge gap therebetween. As there are provided with a plurality of chips, the consumption resistance may be remarkably increased.

According to the above mentioned embodiments, the reliable bonding can be realized by the resistance welding at a lower cost than that of the laser beam welding. As the result, the high quality and lower cost spark plug having Ir alloy can be provided and, further, the longer life of the spark plug can be expected, as the replacement interval of the spark plug is prolonged to a large extend because of the increased bonding strength. The above spark plug is applicable in particular under the severe heat load environment.

Though the above mentioned embodiments were explained as the same construction of the chip and the stress releasing layer on each side of the center and ground electrodes, it goes without saying that at least one side of the center and ground electrodes may have such embodiments.

What is claimed is:

1. A spark plug comprising;

a center electrode having a chip mounting portion;

a housing holding, but insulated with, the center electrode;

a ground electrode fixed at the housing and having a chip mounting portion which faces the chip mounting portion of the center electrode with a discharge gap;

a chip made of an iridium (Ir) alloy and mounted on at least one of the respective chip mounting portions of the ground and center electrodes; and a stress releasing layer arranged between the chip and the one of the respective chip mounting portions of the ground and center electrodes, material of the one of the respective chip mounting portions of the ground and center electrodes being a nickel (Ni) base alloy;

wherein the value of linear expansion co-efficient of the stress releasing layer is intermediate between that of the Ir alloy and that of the Ni base alloy and, further, the value of Young's modulus of the stress releasing layer is less than those of the Ir alloy and the Ni base alloy.

2. A spark plug according to claim 1, wherein the chip is made of material including more than 50 Wt % of Ir.

3. A spark plug according to claim 1, wherein the chip is made of material including more than 50 Wt % of Ir and at least one of material of Rh, Pt, Ru, Pd and W.

4. A spark plug according to claim 1, wherein Young's modulus of material of the stress releasing layer is less than $15\times10^4$ Mpa at the temperature of 900° C.

5. A spark plug according to claim 4, wherein Young's modulus of material of the stress releasing later is more than $5\times10^4$ Mpa at the temperature of 900° C.

6. A spark plug according to claim 4, wherein the linear expansion co-efficient of the stress releasing layer falls within $10\times10^{-6}$ (/° C.) and $11\times10^{-6}$ (/° C.).

7. A spark plug according to claim 1, wherein material of the stress releasing layer is an alloy including Pt.

8. A spark plug according to claim 7, wherein material of the stress releasing layer is a Pt—Ir—Ni alloy.

9. A spark plug according to claim 8, wherein the Pt—Ir—Ni alloy is comprised of 65 to 89 Wt % Pt, 10 to 30 Wt % Ir and 1 to 5 Wt % Ni.

10. A spark plug according to claim 7, wherein the stress releasing layer is comprised of a first stress releasing layer arranged on the side of the chip and a second stress releasing layer arranged between the first stress releasing layer and the one of the respective chip mounting portions of the ground and center electrodes, the value of the linear expansion co-efficient of the second stress releasing layer being intermediate between that of the first stress releasing layer and that of the Ni base alloy.

11. A spark plug according to claim 10, wherein material of the first stress releasing layer is a Pt—Ir alloy and material of the second stress releasing layer is a Pt—Ni alloy.

12. A spark plug according to claim 1, wherein the thickness of the stress releasing layer is more than 0.2 mm.

13. A spark plug according to claim 12, wherein the thickness of the stress releasing layer is less than 0.6 mm.

14. A spark plug comprising;

a center electrode having a chip mounting portion;

a housing holding, but insulated with, the center electrode;

a ground electrode fixed at the housing and having a chip mounting portion which faces the chip mounting portion of the center electrode with a discharge gap;

a chip made of iridium (Ir) alloy including more than 50 Wt % Ir and mounted on at least one of the respective chip mounting portions of the ground and center electrodes; and a stress releasing layer bonded by resistance welding between the chip and the one of the respective chip mounting portions of the ground and center electrodes, material of the one of the respective chip mounting portions of the ground and center electrodes being a nickel (Ni) base alloy;

wherein the value of linear expansion co-efficient of the stress releasing layer is intermediate between that of the Ir alloy and that of the Ni base alloy, the chip is partly embedded in the stress releasing layer, and the bonded junction of the chip and the stress releasing layer is shaped as a uniformly curved dome surface extending to an exposed surface of the stress releasing layer which faces the other one of the respective chip mounting portions of the ground and center electrodes.

15. A spark plug according to claim 14, wherein the diameter of the chip is less than 2.0 mm.

16. A spark plug according to claim 15, wherein the diameter of the chip is more than 0.1 mm.

17. A spark plug according to claim 14, wherein material of the chip includes at least one of Rh, Pt, Ru, Pd and W.

18. A method for manufacturing the spark plug according to claim 14 comprising the steps of:

preparing a ball made of an alloy containing more than 50 Wt % Ir for the chip; and bonding the ball through the stress releasing layer on the one of the respective chip mounting portions of the center and ground electrodes by resistance welding.

19. A method for manufacturing the spark plug according to claim 14 comprising the steps of:

bonding the stress releasing layer on the one of the respective chip mounting portions of the center and ground electrodes by resistance welding; and bonding by resistance welding a ball made of an alloy containing more than 50 Wt % Ir for the chip on the stress releasing layer.

20. A spark plug comprising;

a center electrode having a chip mounting portion;

a housing holding, but insulated with, the center electrode;

a ground electrode fixed at the housing and having a chip mounting portion which faces the chip mounting portion of the center electrode with a discharge gap;

a chip member made of an iridium (Ir) alloy including more than 50 Wt % Ir and mounted on at least one of the respective chip mounting portions of the ground and center electrodes; and a stress releasing layer bonded by resistance welding between the chip member and the one of the respective chip mounting portions of the ground and center electrodes, material of the one of the respective chip mounting portions of the ground and center electrodes being a nickel (Ni) base alloy;

wherein the chip member is comprised of a plurality of chips bonded respectively on the stress releasing layer, and wherein each of the chips is partly embedded into the stress releasing layer, and each of the bonded junctions of the plurality of chips and the stress releasing layer is shaped as a uniformly curved dome surface extending to an exposed surface of the stress releasing layer which faces the other one of the respective chip mounting portions of the ground and center electrodes.

21. A spark plug according to claim 20, wherein each diameter of the plurality of chips is less than 2.0 mm.

22. A spark plug according to claim 21, wherein each diameter of the plurality of chips is more than 0.1 mm.

23. A spark plug according to claim 20, wherein each material of the chips includes at least one of Rh, Pt, Ru, Pd and W.

24. A method for manufacturing the spark plug according to claim 20 comprising the steps of:

bonding the stress releasing layer on the one of the respective chip mounting portions of the center and ground electrodes by resistance welding; and bonding by resistance welding a plurality of balls made of an alloy containing more than 50 Wt % Ir for the respective chips on the stress releasing layer.

25. A spark plug comprising;

a center electrode having a chip mounting portion;

a housing holding, but insulated with, the center electrode;

a ground electrode fixed at the housing and having a chip mounting portion which faces the chip mounting portion of the center electrode with a discharge gap;

a chip member made of an iridium (Ir) alloy including more than 50 Wt % Ir and mounted on at least one of the respective chip mounting portions of the ground and center electrodes; and a stress releasing layer bonded by resistance welding between the chip member and the one of the respective chip mounting portions of the ground and center electrodes, material of the one of the respective chip mounting portions of the ground and center electrodes being a nickel (Ni) base alloy;

wherein the chip member is comprised of a plurality of chips bonded respectively on the stress releasing layer, and wherein each of the plurality of chips is shaped as a disk, whose diameter is less than 1.5 mm before the resistance welding, and a circular surface on each one side of the chips constitutes each of bonded junctions of the chips and the stress releasing layer.

26. A spark plug comprising;

a center electrode having a chip mounting portion;

a housing holding, but insulated with, the center electrode;

a ground electrode fixed at the housing and having a chip mounting portion which faces the chip mounting portion of the center electrode with a discharge gap;

a chip made of iridium (Ir) alloy including more than 50 Wt % Ir and mounted on at least one of the respective chip mounting portions of the ground and center electrodes; and a stress releasing layer bonded by resistance welding between the chip and the one of the respective chip mounting portions of the ground and center electrodes, material of the one of the respective chip mounting portions of the ground and center electrodes being a nickel (Ni) base alloy;

wherein the value of linear expansion co-efficient of the stress releasing layer is intermediate between that of the Ir alloy and that of the Ni base alloy and the bonded junction of the chip and the stress releasing layer is shaped as a curved surface, and wherein Young's modulus of the stress releasing layer is less than those of the chip and the one of the respective chip mounting portions of the center and ground electrodes.

27. A spark plug comprising;

a center electrode having a chip mounting portion;

a housing holding, but insulated with, the center electrode;

a ground electrode fixed at the housing and having a chip mounting portion which faces the chip mounting portion of the center electrode with a discharge gap;

a chip member made of an iridium (Ir) alloy including more than 50 Wt % Ir and mounted on at least one of the respective chip mounting portions of the ground and center electrodes; and a stress releasing layer bonded by resistance welding between the chip member and the one of the respective chip mounting portions of the ground and center electrodes, material of the one of the respective chip mounting portions of the ground and center electrodes being a nickel (Ni) base alloy;

wherein the chip member is comprised of a plurality of chips bonded respectively on the stress releasing layer;

wherein Young's modulus of the stress releasing layer is less than those of any of the plurality of chips and the one of the respective discharge portions of the center and ground electrodes.

28. A spark plug comprising:

a center electrode having a chip mounting portion;

a housing holding, but insulated with, the center electrode;

a ground electrode fixed at the housing and having a chip mounting portion which faces the chip mounting portion of the center electrode with a discharge gap;

a chip made of iridium (Ir) alloy including more than 50 Wt % Ir and mounted on at least one of the respective chip mounting portions of the ground and center electrodes; and a stress releasing layer bonded by resistance welding between the chip and the one of the respective chip mounting portions of the ground and center electrodes, material of the one of the respective chip mounting portions of the ground and center electrodes being a nickel (Ni) base alloy;

wherein the value of linear expansion co-efficient of the stress releasing layer is intermediate between that of the Ir alloy and that of the Ni base alloy and the chip is partly embedded in the stress releasing layer and the bonded junction of the chip and the stress releasing layer is shaped as a curved surface, and wherein before resistance welding to the stress releasing layer, the chip has a general shape of a ball and the junction shaped as a curved surface is formed by pressing the ball shaped chip on a surface of the stress releasing layer facing the other one of the respective chip mounting portions of the ground and center electrodes and resistance welding so the ball shaped chip is embedded in the stress releasing layer while its shape is deformed.

29. A spark plug comprising;

a center electrode having a chip mounting portion;

a housing holding, but insulated with, the center electrode;

a ground electrode fixed at the housing and having a chip mounting portion which faces the chip mounting portion of the center electrode with a discharge gap;

a chip member made of an iridium (Ir) alloy including more than 50 Wt % Ir and mounted on at least one of the respective chip mounting portions of the ground and center electrodes; and a stress releasing layer bonded by resistance welding between the chip member and the one of the respective chip mounting portions of the ground and center electrodes, material of the one of the respective chip mounting portions of the ground and center electrodes being a nickel (Ni) base alloy;

wherein the chip member is comprised of a plurality of chips bonded respectively on the stress releasing layer, wherein each of the chips is partly embedded into the stress releasing layer, and each of the bonded junctions of the plurality of chips and the stress releasing layer is shaped as a curved surface, and wherein before resistance welding to the stress releasing layer, each said chip has a general shape of a ball and each said junction shaped as a curved surface is formed by pressing the respective ball shaped chip on a surface of the stress releasing layer facing the other one of the respective chip mounting portions of the ground and center electrodes and resistance welding so the ball shaped chip is embedded in the stress releasing layer while its shape is deformed.

* * * * *